US008736456B2

(12) United States Patent
Krcma

(10) Patent No.: US 8,736,456 B2
(45) **Date of Patent: *May 27, 2014**

(54) GAS SENSING METHOD AND INSTRUMENT THEREFOR

(75) Inventor: Jan Krcma, Valparaiso, IN (US)

(73) Assignee: SENSIT Technologies, Valparaiso, IN (US)

( * ) Notice: Subject to any disclaimer, the term of this patent is extended or adjusted under 35 U.S.C. 154(b) by 575 days.

This patent is subject to a terminal disclaimer.

(21) Appl. No.: 12/835,885

(22) Filed: Jul. 14, 2010

(65) Prior Publication Data

US 2011/0169649 A1 Jul. 14, 2011

Related U.S. Application Data

(60) Provisional application No. 61/230,429, filed on Jul. 31, 2009.

(51) Int. Cl.
*G08B 17/10* (2006.01)

(52) U.S. Cl.
USPC ..... 340/632; 340/636.11; 340/693.1

(58) Field of Classification Search
USPC ..... 340/632, 511, 692, 636.11, 636.1, 644, 340/645, 656, 679–680, 683, 693.1
See application file for complete search history.

(56) References Cited

U.S. PATENT DOCUMENTS 4,063,821 A * 12/1977 King et al. ..... 356/634
4,166,380 A * 9/1979 Batz ..... 73/31.06
4,639,882 A * 1/1987 Keats ..... 702/108
5,491,815 A * 2/1996 Basso et al. ..... 713/502
6,025,755 A * 2/2000 Camparo ..... 331/3
7,268,609 B2 9/2007 van Staveren et al.
7,304,741 B2 12/2007 Sadeghi et al.
7,764,186 B2 * 7/2010 Krcma ..... 340/632

OTHER PUBLICATIONS

B. Licznerski, Thick-film gas microsensors based on tin dioxide, vol. 52, No. 1, 2004, Bulletin of the Polish Academy of Sciences Technical Sciences.

FIGARO an ISO9001company, technical information for TGS2611, Revised Apr. 2002.

* cited by examiner

*Primary Examiner* — Daniel Previl
(74) *Attorney, Agent, or Firm* — Hartman Global IP Law; Gary M. Hartman; Domenica N. S. Hartman

(57) ABSTRACT

A method and instrument capable of producing an audible tick that increases with detected gas concentrations, is suitable for indicating relatively low levels of gas concentrations, and enables the adjustment of the tick rate to provide an accurate audible indication of gas levels at higher concentrations. The method and instrument entail sensing the presence of the gas and generating an analog sensor output based on a concentration of the gas in the environment, and then processing the analog sensor output through an audio circuitry to generate therefrom an audible tick having a frequency in proportion to the analog sensor output. The processing step includes the use of an analog control loop signal to selectively increase and decrease the frequency of the audible tick.

19 Claims, 3 Drawing Sheets

GAS SENSING METHOD AND INSTRUMENT THEREFOR

CROSS REFERENCE TO RELATED APPLICATIONS

This application claims the benefit of U.S. Provisional Application No. 61/230,429, filed Jul. 31, 2009, the contents of which are incorporated herein by reference. In addition, this application is related to co-pending U.S. patent application Ser. No. 12/107,445, filed Apr. 22, 2008, the contents of which are incorporated herein by reference.

BACKGROUND OF THE INVENTION

The present invention generally relates to instruments and methods for detecting and/or measuring concentration levels of substances. More particularly, this invention relates to a gas sensing method and instrument capable of detecting the presence of a gas, for example, a combustible gas, over a wide range of levels within an environment, and accurately measuring the concentration of the gas in the environment.

Gas detectors are widely used in various applications, nonlimiting examples of which include medical and emergency services and the mining and utility industries, to detect the presence of potentially harmful or dangerous gases, especially combustible hydrocarbon gases. Gas detectors typically use a thick-film metal oxide semiconductor sensor whose metal oxide film is reactive to the targeted gas and when reacted exhibits a change (usually a drop) in electrical resistance. The response of these sensors is nonlinear relative to the amount of targeted gas present, and as such typical gas leak detectors are very sensitive at low level concentrations, for example, up to about 10,000 ppm (1% by volume), and become less sensitivity at higher concentrations (generally at a few percentages of gas concentration) until the output eventually encounters signal saturation. As an alternative to semiconductor-type gas sensors, pellistors and other types of sensors, e.g., infrared (IR) sensors, having essentially linear responses may be used in gas detectors. However, their linear responses render these sensors not ideally suited for use as leak detectors requiring high sensitivity at very low gas concentrations (e.g., below a few percentages of gas concentration).

Gas detectors are typically equipped with a visual readout that provides a quantitative assessment of the gas concentration, typically in parts per million (PPM) and/or the percentage of lower explosion limit (% LEL) for the particular gas. Gas detectors can also be equipped with an audible device that generates a sound proportional to the sensed gas concentration. One example is an audible "tick" sound that increases in frequency or rate (ticks per second) proportional to the sensed concentration. As used herein, an "audible tick" refers to a variable repetition rate of audio pulses, each, for example, approximately 250 msec in duration, to which a human ear is very responsive. The tick rate alerts the user to the presence of a gas to which the sensor is sensitive and, prior to the onset of signal saturation, the relative amount of gas.

Because the responses of semiconductor-type sensors are nonlinear relative to the amount of targeted gas present, gas detectors are often equipped with an adjustment capability that enables the user to adjust the audible output to cover different ranges. FIG. 1 schematically represents one such technique that provides for manual adjustment of the audible output (resulting from increased sensed concentration) using a potentiometer. FIG. 1 shows a gas detection circuit 10 that utilizes a sensor 12, for example, of the nonlinear type described above. The analog output of the sensor 12 is interfaced with audio circuitry that contains a linear summing amplifier 14, a voltage-controlled oscillator (VCO) 16 and a pulse generator 18 that cooperate to convert voltage to a pulsed output, and an audio speaker 20 that generates an audible tick in response to the pulsed output. The analog output of the sensor 12 is amplified by the amplifier 14 before passing through the VCO 16, whose output is characterized by a frequency of oscillation varied by the applied analog (DC) voltage of the amplifier 14. The pulse generator 18 utilizes the oscillating analog output of the VCO 16 to generate the pulsed output (tick signal) based on the frequency of the output of the VCO 16. The pulsed output of the pulse generator 18 drives the audio speaker 20, which produces an audible "tick" whose rate or frequency is in proportion to the gas concentration sensed by the sensor 12. The sensor 12 interfaces with the audio circuitry by functioning as part of a resistive (voltage) divider circuit connected to the amplifier 14 in parallel with a potentiometer 22. A knob or wheel (not shown) can be conventionally used to make adjustments to the electrical resistance of the potentiometer 22. Both the sensor 12 and potentiometer 22 are connected to a suitable DC or AC voltage source (not shown). By making manual adjustments to the potentiometers 22, a user is able to adjust the frequency of the output of the VCO 16 to set an initial tick rate for the audio circuit, as well as make subsequent adjustments to the frequency of the output of the VCO 16 and resulting tick rate as may be desired, for example, as the tick rate approaches a saturation level at which the tick rate is no longer perceptible to the user.

FIG. 2 schematically represents an existing digital technique for providing manual adjustment of the output of a gas detector. A gas detection circuit 30 is shown in FIG. 2 as utilizing a sensor 32 interfaced with audio circuitry that contains a linear summing amplifier 34, an analog-to-digital (A/D) converter 35 that generates a digital output based on the amplified analog output of the amplifier 34, a microprocessor 36 that generates a digital output based on the digital output of the converter 35, a pulse generator 38 that converts the digital output of the microprocessor 36 to a pulsed output, and an audio speaker 40 that produces an audible "tick" whose rate or frequency is in proportion to the gas concentration sensed by the sensor 32. The capability for making manual adjustments to the tick rate is provided by a pushbutton 42 that enables a user to input commands to the microprocessor 36. While effective and economical, this technique does not quite provide an immediate and proportional adjustment to the audio output, which makes pinpointing the location and source of a gas leak rather cumbersome.

In view of the above, it can be appreciated that improvements would be desirable in the ability to adjust the tick rate of gas detectors, so that gas leaks can be quickly detected at low concentrations, and then adjustments to the tick rate can be made so that the location of the leak source (where gas concentrations may be much higher) can be more quickly identified.

BRIEF DESCRIPTION OF THE INVENTION

The present invention provides a method and instrument capable of producing an audible tick that increases with detected gas concentrations, is suitable for indicating relatively low levels of gas concentrations, and enables the adjustment of the tick rate to provide an accurate audible indication of gas levels at higher concentrations.

According to a first aspect of the invention, the method includes sensing the presence of the gas and generating an analog sensor output based on a concentration of the gas in the environment, and then processing the analog sensor output through an audio circuitry to generate therefrom an audible tick having a frequency in proportion to the analog sensor output. The processing step includes amplifying the analog sensor output with a summing amplifier to generate an amplified analog output, producing an oscillating analog output based on the amplified analog output, converting the oscillating analog output to a pulsed output whose pulse rate is in proportion to the gas concentration sensed by the sensing means, emitting the audible tick based on the pulsed output, producing a digital output with a microprocessor based on the oscillating analog output, converting the digital output to an analog control loop signal, delivering the analog control loop signal to the summing amplifier, and adjusting the digital output of the microprocessor to selectively increase and decrease the frequency of the audible tick emitted by the audio speaker.

According to a second aspect of the invention, the instrument includes means for sensing the presence of the gas and generating an analog sensor output based on the concentration of the gas in the environment, and audio circuitry for processing the analog sensor output of the sensing means and generating therefrom an audible tick having a frequency in proportion to the analog sensor output. The audio circuitry includes a summing amplifier that amplifies the analog sensor output to generate an amplified analog output, means for producing an oscillating analog output based on the amplified analog output, means for converting the oscillating analog output to a pulsed output whose pulse rate is in proportion to the gas concentration sensed by the sensing means, an audio speaker that emits the audible tick based on the pulsed output, a microprocessor that produces a digital output based on the oscillating analog output, a digital-to-analog converter that converts the digital output to an analog control loop signal and delivers the analog control loop signal to the summing amplifier, and means for adjusting the digital output of the microprocessor to selectively increase and decrease the frequency of the audible tick emitted by the audio speaker.

A significant advantage of this invention is that the method and instrument produce an audible tick whose rate can be readily and quickly adjusted to provide an audible indication of gas concentrations over a broad range of concentrations.

Other objects and advantages of this invention will be better appreciated from the following detailed description.

DETAILED DESCRIPTION OF THE INVENTION

Figure 3:
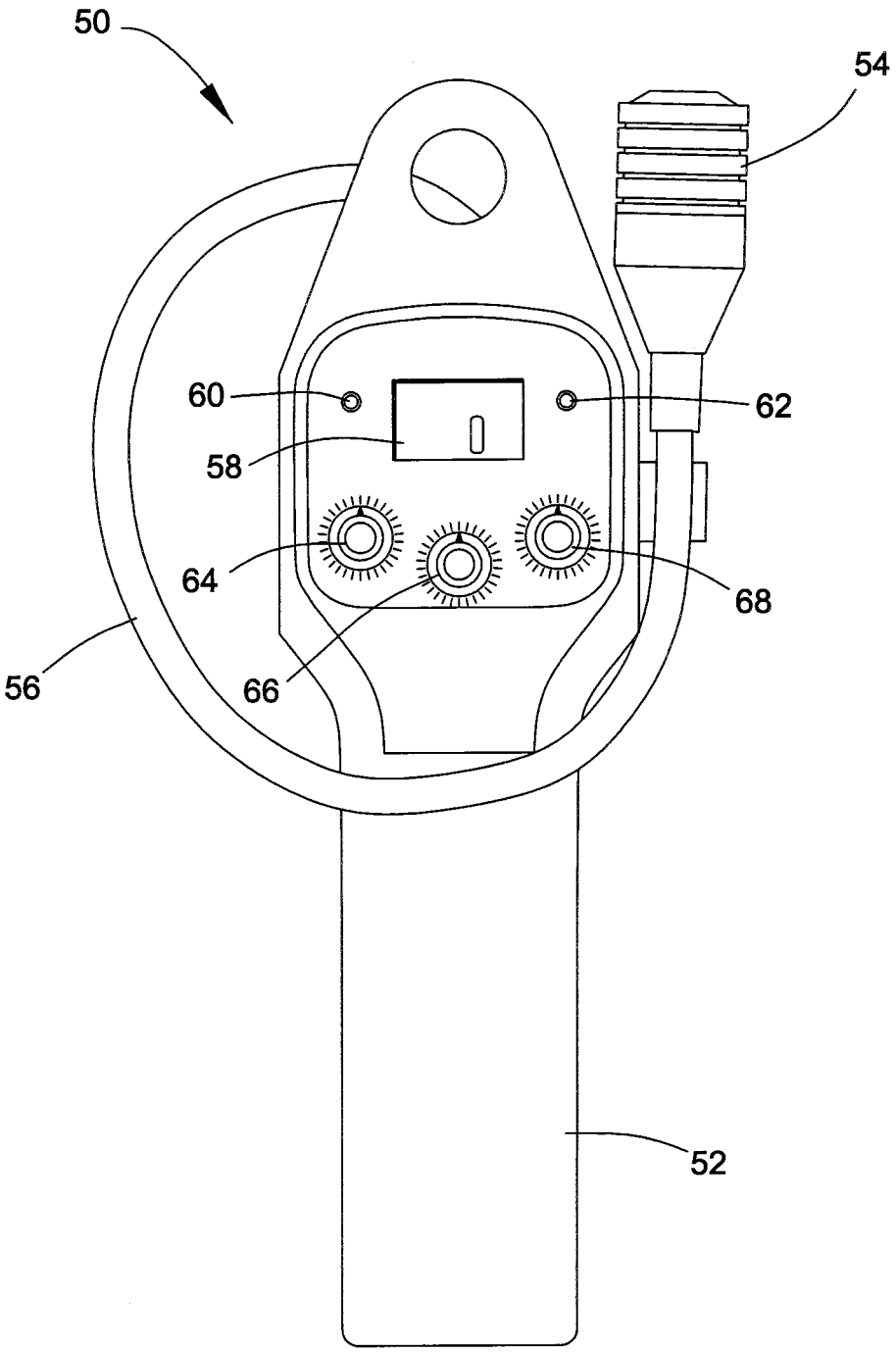
FIG. 3 represents an embodiment of a gas sensing instrument suitable for use with the present invention.
Figure 4:
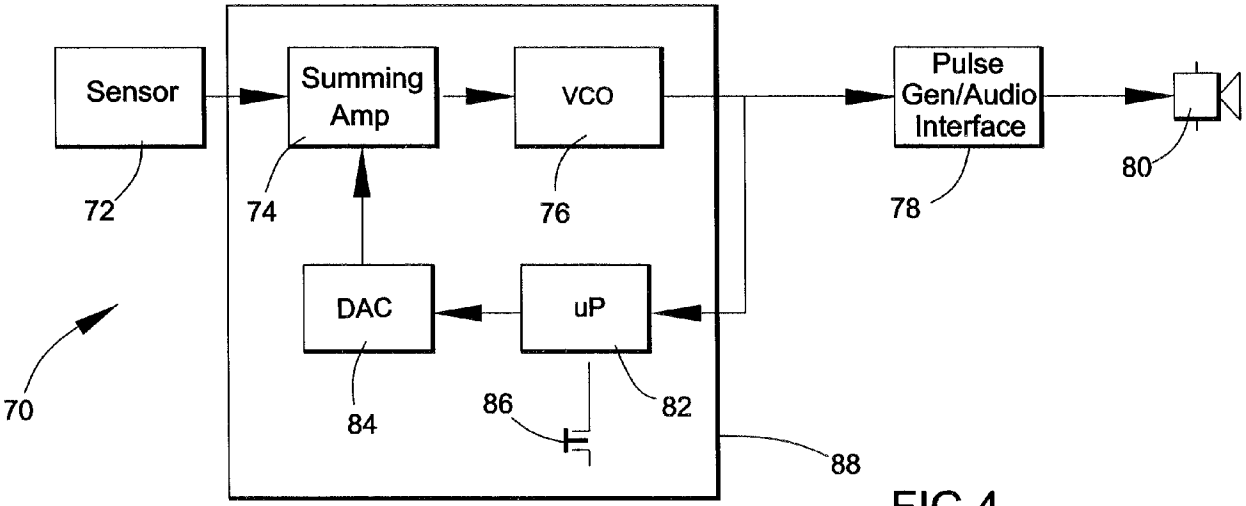
FIG. 4 is a schematic representation of a gas detection circuit for a gas sensing instrument in accordance with a first embodiment of this invention.
Figure 5:
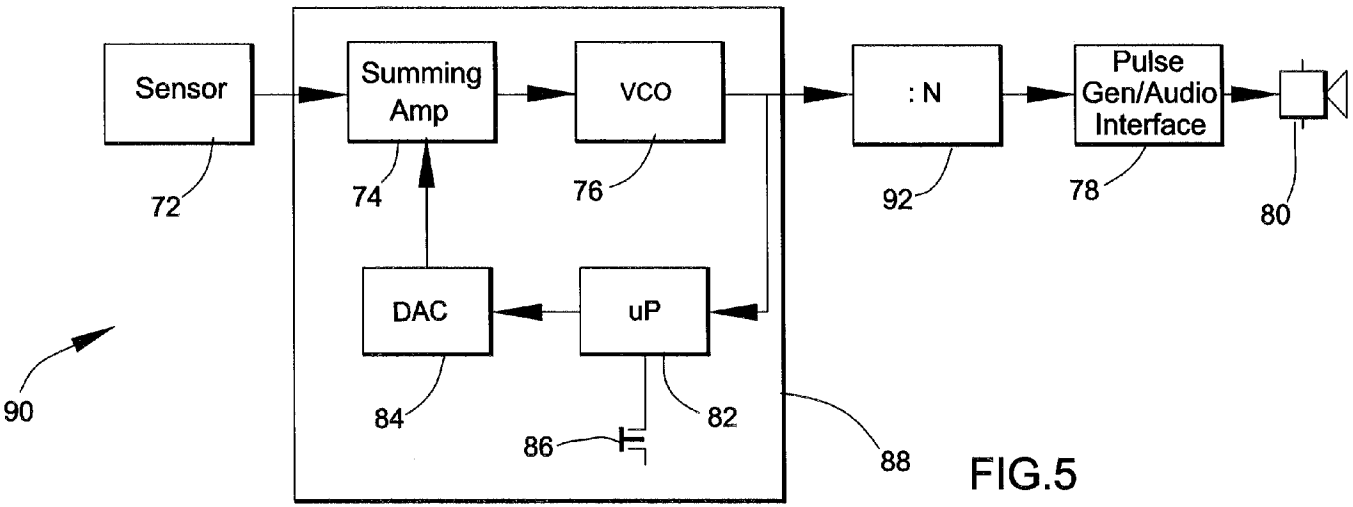
FIG. 5 is a schematic representation of a gas detection circuit for a gas sensing instrument in accordance with a preferred embodiment of this invention.

FIG. 3 represents an embodiment of a gas sensing instrument 50 of a type that can make use of gas detection circuits 70 and 90 represented in FIGS. 4 and 5. The instrument 50 is of a type for detecting one or more gases, including but not limited to natural gas and/or any of its constituents (for example, methane, ethane, propane, butane, and pentane), alcohols, and various other combustible hydrocarbon-containing gases.

As represented in FIG. 3, the instrument 50 is configured as a handheld unit that includes a main body 52, a sensor tip 54, and a flexible gooseneck 56 that physically and electrically connects the sensor tip 54 to the body 52. A sensor (not shown) is located within the tip 54 and is adapted to detect and measure a gas of interest. For this purpose, the sensor may be, for example, a thick-film metal oxide semiconductor sensor, though other types of sensors are also within the scope of the invention. The sensor is preferably, though not necessarily, capable of detecting gas concentrations of as little as about 10 PPM. The flexible gooseneck 56 facilitates the placement of the tip 54 in locations otherwise difficult to access when attempting to locate the source of a gas leak.

Figure 1:
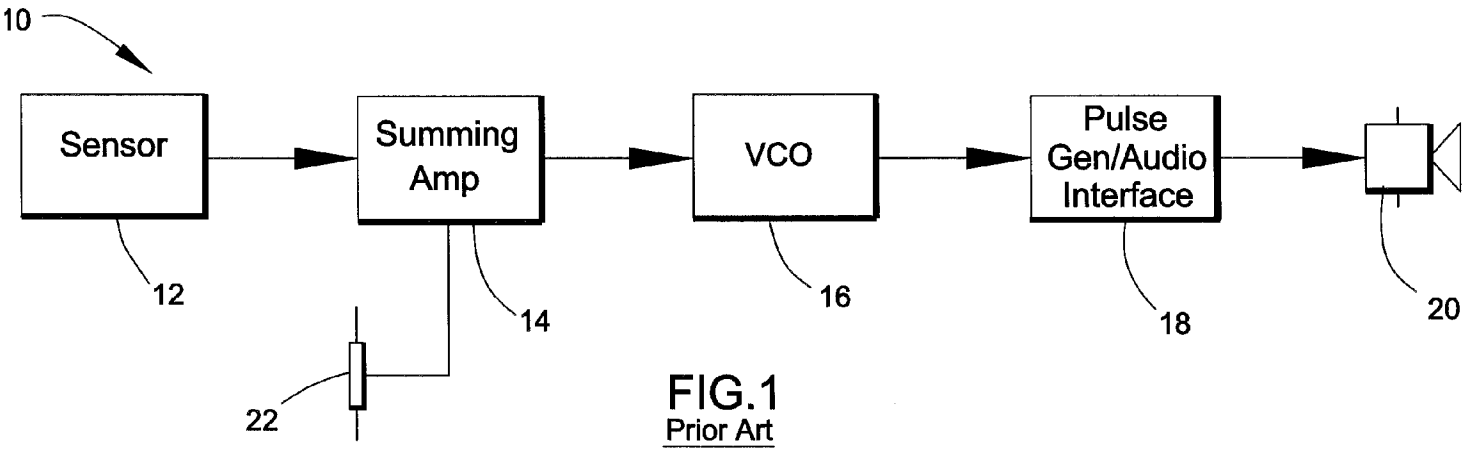
FIG.1 Prior Art
FIGS. 1 and 2 are schematic representations of gas detection circuits of gas sensing instruments in the prior art.
Figure 2:
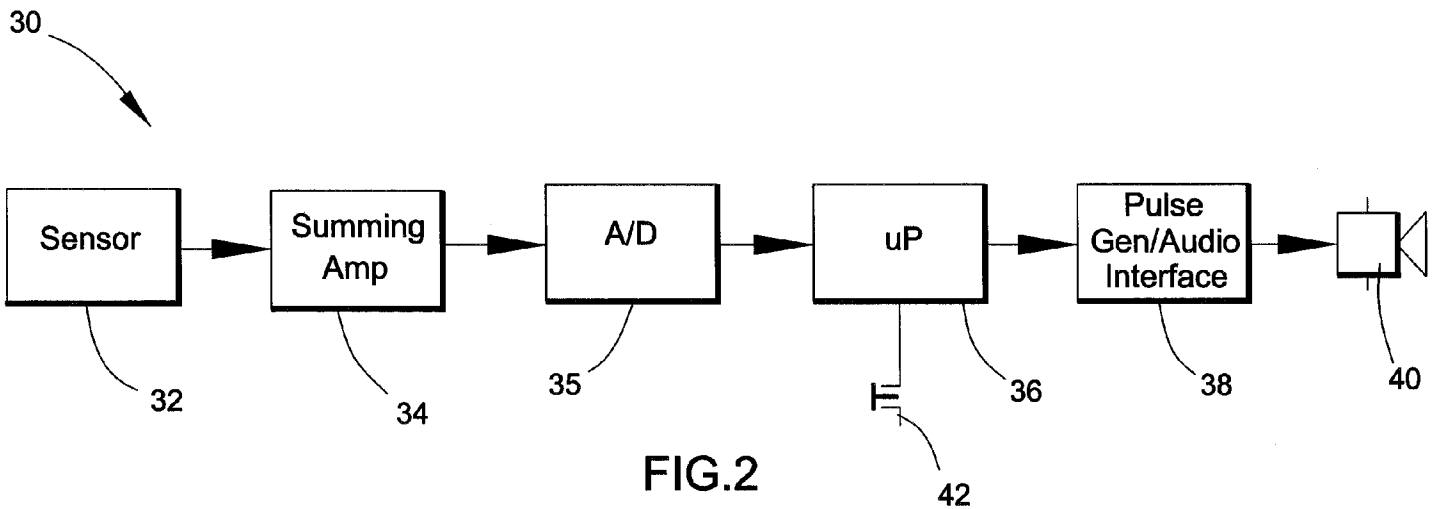
FIG.2 Prior Art

The lower end of the body 52 (as viewed in FIG. 1) can be sized for containing batteries (not shown) for powering the instrument 50, while a display panel 58, indicator lights 60 and 62, and controls 64, 66 and 68 are located at the upper end of the body 52. The display panel 58 is used to continuously display the output of the sensor as gas concentration, preferably in both PPM and % LEL. In a preferred embodiment of the instrument 50, the display panel 58 automatically switches from displaying PPM to % LEL if the gas concentration exceeds a predetermined level, for example, 990 PPM (corresponding to about 2% LEL for methane, whose LEL is about 50,000 PPM, or about 5% by volume). In addition to the display panel 58, the instrument 50 includes audible and visual alarms to warn the operator of hazards. These alarms can be set in either the PPM or LEL modes. One of the indicator lights 60 can provide an indication that the instrument 50 is ready for use, and the other light 62 to indicate that a preset alarm point has been exceeded. The controls 64, 66 and 68 are represented as being buttons below the display panel 58. The controls 64, 66 and 68 can provide various functions, including the activation and control of an audible "tick" whose rate or frequency is proportional to the gas concentration sensed by the sensor, as will be discussed in more detail below. Preferred functions of the controls 64, 66 and 68 include initiating the audible tick, muting the audible tick, and resetting the tick rate. The instrument 50 is preferably capable of generating an audible tick in response to low gas concentrations, for example, as little as about 100 PPM. A speaker (not shown) for emitting the audible tick can be located at any convenient location of the instrument 50, for example, the backside of the body 52.

The above description of the instrument 50 is intended to be exemplary, and not necessarily a limitation to the scope of the invention. Preferred aspects of the invention are represented in FIGS. 4 and 5, which schematically represent two embodiments of gas detection circuits 70 and 90 of this invention, each employing a digital technique for providing manual adjustments of the rate of an audible tick produced by each circuit 70 and 90. As will become evident from the following discussion, the circuits 70 and 90 enable the tick rate of a gas sensing instrument (such as that shown in FIG. 3) to be adjusted to provide an accurate indication of gas levels at relatively low and high concentrations. The circuit components represented in FIGS. 4 and 5 are well known in the art and therefore will not be discussed in any detail here.

In FIG. 4, the circuit 70 is represented as including a sensor 72, such as a semiconductor sensor of the type noted above. The sensor 72 is powered by a suitable DC or AC voltage source (not shown). The analog output of the sensor 72 is interfaced with audio circuitry that contains a linear summing amplifier 74, a voltage-controlled oscillator (VCO) 76 and a pulse generator 78 that cooperate to convert voltage to a pulsed output whose pulse rate is in proportion to the gas concentration sensed by the sensor 72, and an audio speaker 80 that emits an audible tick based on the pulsed output of the pulse generator 78. The output of the sensor 72 is amplified by the amplifier 74 before passing through the VCO 76, whose analog output is characterized by a frequency of oscillation varied by the applied DC voltage of the amplifier 74. The pulse generator 78 utilizes the oscillating output of the VCO 76 to generate a pulsed output based on the frequency of the output of the VCO 76. The pulsed output of the pulse generator 78 is effectively a tick signal that drives the audio speaker 80, which produces an audible tick whose rate or frequency is in proportion to the tick signal and, therefore, the gas concentration sensed by the sensor 72.

FIG. 4 shows the audio circuitry as further comprising a control loop 88 containing a microprocessor (uP) 82 and an analog-to-digital converter (DAC) 84. The microprocessor 82 utilizes the oscillating analog output of the VCO 76 as an input to generate a digital output. The control loop 88 further includes means for providing control inputs to the microprocessor 82 for the purpose of making manual adjustments to the tick signal produced by the VCO 76 and pulse generator 78. In FIG. 4, the input means is represented as a pushbutton 86, though other suitable means are known and could be used. This pushbutton 86 can correspond to any one of the pushbutton controls 64, 66 and 68 represented for the gas detecting instrument 50 of FIG. 3. Pressing the pushbutton 86 results in a manual adjustment to the digital output of the microprocessor 82, which can be preprogrammed to have any number of preset digital output levels. The digital output of the microprocessor 82 is then converted by the DAC 84 to an analog control loop output and sent to the summing amplifier 74, whose output is increased or decreased by the analog output of the DAC 84. In this manner, a user is able to operation of the pushbutton 86 to decrease or increase, as desired or necessary, the rate of the tick signal generated by the VCO 76 and pulse generator 78 and, consequently, the audible tick rate emitted by the speaker 80. For example, the user can manually adjust the frequency of the output of the VCO 76 to set an initial tick rate for the audio circuitry. This initial tick rate may be relatively slow or fast, depending on the preference of the user. During use, the pushbutton 86 can be used to make adjustments to the frequency of the output of the VCO 76 and resulting tick rate as may be desired, for example, as the tick rate approaches a saturation level at which the tick rate would no longer be perceptible to the user. For example, the tick rate may be reset to the initial tick rate. Advantageously, the circuit 70 provides a natural proportional response to gas concentrations, as well as to natural proportional response to gas concentration increases.

In practice, the circuit 70 of FIG. 4 may not be optimal, in that the response of the control loop 88 containing the microprocessor 82 and DAC 84 may require several seconds of processing time before the desired effect on the tick rate becomes evident. The circuit 90 represented in FIG. 5 is believed to provide a faster response, and is therefore believed to represent a preferred embodiment of the invention. For convenience, identical reference numerals are used in FIG. 5 to denote the same or functionally equivalent components described for the circuit 70 of FIG. 4. In view of similarities between the first and second embodiments of FIGS. 4 and 5, respectively, the following discussion of FIG. 5 will focus primarily on aspects of the second embodiment that differ from the first embodiment in some notable or significant manner. Other aspects of the second embodiment not discussed in any detail can be essentially as was described for the first embodiment.

Similar to the embodiment of FIG. 4, the circuit 90 of FIG. 5 is represented as including a sensor 72, audio circuitry containing a linear summing amplifier 74, VCO 76, pulse generator 78, audio speaker 80, microprocessor 82, DAC 84, and pushbutton 86 that provides inputs to the microprocessor 82 for the purpose of making manual adjustments to the tick rate generated by the VCO 76 and pulse generator 78, similar to what was described for FIG. 4. In addition, the circuit 90 of FIG. 5 includes a frequency divider (:N) 92 between the VCO 76 and the pulse generator 78.

As with the embodiment of FIG. 4, the pushbutton 86 can be operated to manually adjust the digital output of the microprocessor 82, which is then converted by the DAC 84 to an analog control loop output and sent to the summing amplifier 74. Consequently, the amplified output of the amplifier 74 is increased or decreased by the analog control loop output to decrease or increase, respectively, the rate of the tick signal generated by the VCO 76 and pulse generator 78 and, consequently, the audible tick rate emitted by the speaker 80. As an additional effect, a user can use the frequency divider 92 to modify (decrease) the frequency of the oscillating analog output generated by the VCO 76 that, when processed by the pulse generator 78, will be in a lower audible range. This feature of FIG. 5 enables the control loop 88 to operate at a frequency at least an order of magnitude higher than that of the tick rate desired to be output by the speaker 80. As a result, the control loop 88 of FIG. 5 is able to have a much faster response than the control loop 88 of FIG. 4. The frequency divider 92 can then be used to selectively drop the frequency to a more desirable frequency for the audible tick. The inclusion of the frequency divider 92 also enables the microprocessor 82 to be used to initially set the tick rate, with subsequent adjustments made with the frequency divider 92, so that the microprocessor 82 is free to perform other processing tasks.

Various modifications to the circuit 90 represented in FIG. 5 are also within the scope of this invention. For example, the functions of the frequency divider 92 and pulse generator 78 could be incorporated in the microprocessor 82. Furthermore, the summing amplifier 74 could have log response.

From the above, it should be appreciated that the circuits 70 and 90 represented in FIGS. 4 and 5 can be employed in a variety of instruments capable of detecting the presence of a gas at relatively low and high levels, as well as the ability to produce an audible tick whose rate can be adjusted to enable initial detection of a gas at low concentrations, and subsequently ascertain its source where the concentration of the gas is likely to be much greater.

While the invention has been described in terms of specific embodiments, it is apparent that other forms could be adopted by one skilled in the art. For example, the physical configurations of the circuits 70 and 90 and their components could differ from that shown, and yet achieve the intended operation described for the circuits 70 and 90. Therefore, the scope of the invention is to be limited only by the following claims.

The invention claimed is:

1. A method for detecting the presence of a gas and measuring a concentration of the gas in an environment, the method comprising the steps of:

sensing the presence of the gas and generating an analog sensor output based on a concentration of the gas in the environment;

processing the analog sensor output through an audio circuitry to generate therefrom an audible tick having a frequency in proportion to the analog sensor output, the processing step comprising:

amplifying the analog sensor output with a summing amplifier to generate an amplified analog output;

producing an oscillating analog output based on the amplified analog output;

converting the oscillating analog output to a pulsed output whose pulse rate is in proportion to the gas concentration sensed by the sensing means;

emitting the audible tick based on the pulsed output;

producing a digital output with a microprocessor based on the oscillating analog output;

converting the digital output to an analog control loop signal;

delivering the analog control loop signal to the summing amplifier; and adjusting the digital output of the microprocessor to selectively increase and decrease the frequency of the audible tick.

2. The method according to claim 1, further comprising reducing the frequency of the oscillating analog output prior to being converted to the pulsed output.

3. The method according to claim 2, wherein the frequency of the oscillating analog output is at least an order of magnitude higher than the frequency of the audible tick.

4. The method according to claim 1, wherein the adjusting step comprises setting the audible tick at an initial frequency and subsequently resetting the frequency of the audible tick to the initial frequency in response to the frequency of the audible tick approaching a saturation level.

5. The method according to claim 1, wherein the adjusting step is performed with a pushbutton.

6. The method according to claim 1, wherein the sensing step is performed with a sensor adapted to sense combustible gases.

7. The method according to claim 6, wherein the sensing step is performed to sense combustible gases.

8. The method according to claim 1, wherein the sensing step is performed with a sensor adapted to sense hydrocarbon-containing gases.

9. The method according to claim 8, wherein the sensing step is performed to sense hydrocarbon-containing gases.

10. The method according to claim 1, wherein the sensing step is performed with a thick-film metal oxide semiconductor sensor.

11. An instrument for detecting the presence of a gas and measuring a concentration of the gas in an environment, the instrument comprising:

means for sensing the presence of the gas and generating an analog sensor output based on the concentration of the gas in the environment;

audio circuitry for processing the analog sensor output of the sensing means and generating therefrom an audible tick having a frequency in proportion to the analog sensor output, the audio circuitry comprising a summing amplifier that amplifies the analog sensor output to generate an amplified analog output, means for producing an oscillating analog output based on the amplified analog output, means for converting the oscillating analog output to a pulsed output whose pulse rate is in proportion to the gas concentration sensed by the sensing means, an audio speaker that emits the audible tick based on the pulsed output, a microprocessor that produces a digital output based on the oscillating analog output, a digital-to-analog converter that converts the digital output to an analog control loop signal and delivers the analog control loop signal to the summing amplifier, and means for adjusting the digital output of the microprocessor to selectively increase and decrease the frequency of the audible tick emitted by the audio speaker.

12. The instrument according to claim 11, further comprising a frequency divider that reduces the frequency of the oscillating analog output prior to being converted to the pulsed output.

13. The instrument according to claim 12, wherein the frequency of the oscillating analog output is at least an order of magnitude higher than the frequency of the audible tick.

14. The instrument according to claim 11, wherein the adjusting means is operable to set the audible tick at an initial frequency and subsequently reset the frequency of the audible tick to the initial frequency in response to the frequency of the audible tick approaching a saturation level.

15. The instrument according to claim 11, wherein the adjusting means is a pushbutton.

16. The instrument according to claim 11, wherein the sensing means is adapted for sensing combustible gases.

17. The instrument according to claim 11, wherein the sensing means is adapted for sensing hydrocarbon-containing gases.

18. The instrument according to claim 11, wherein the sensing means is a thick-film metal oxide semiconductor sensor.

19. The instrument according to claim 11, wherein the microprocessor comprises the converting means.

* * * * *